US008588655B2

(12) United States Patent
Berg

(10) Patent No.: US 8,588,655 B2
(45) Date of Patent: Nov. 19, 2013

(54) DEVICE AND METHOD TO DEVELOP POTENTIAL IMAGES GENERATED ON AN INTERMEDIATE IMAGE CARRIER IN AN ELECTROGRAPHIC PRINTING OR COPYING DEVICE

(75) Inventor: Martin Berg, Poing (DE)

(73) Assignee: Océ Printing Systems, GmbH, Poing (DE)

( * ) Notice: Subject to any disclaimer, the term of this patent is extended or adjusted under 35 U.S.C. 154(b) by 273 days.

(21) Appl. No.: 13/034,318

(22) Filed: Feb. 24, 2011

(65) Prior Publication Data

US 2011/0206416 A1 Aug. 25, 2011

(30) Foreign Application Priority Data

Feb. 25, 2010 (DE) ..... 10 2010 000 549

(51) Int. Cl.
*G03G 15/10* (2006.01)

(52) U.S. Cl.
USPC ..... 399/237; 399/238; 399/239; 399/240; 399/249

(58) Field of Classification Search
USPC ..... 399/237, 238, 239, 240, 249
See application file for complete search history.

(56) References Cited

U.S. PATENT DOCUMENTS

| | | | | |
|---|---|---|---|---|
| 5,424,813 | A | 6/1995 | Schlueter, Jr. | |
| 5,815,779 | A | 9/1998 | Abramsohn | |
| 6,029,036 | A | 2/2000 | Itaya et al. | |
| 6,371,024 | B1 | 4/2002 | Scholzig et al. | |
| 7,463,851 | B2 | 12/2008 | Berg et al. | |
| 7,522,865 | B2 * | 4/2009 | Hasdai et al. | 399/237 |
| 2008/0279597 | A1 | 11/2008 | Berg et al. | |
| 2009/0110423 | A1 * | 4/2009 | Tanaka | 399/57 |

FOREIGN PATENT DOCUMENTS

| | | | |
|---|---|---|---|
| DE | 4408615 | A1 | 9/1995 |
| DE | 69511763 | T2 | 11/1995 |
| DE | 102005055156 | B3 | 5/2007 |
| EP | 0727720 | B1 | 12/2000 |
| EP | 1097813 | A2 | 5/2001 |
| WO | 2005013013 | A2 | 2/2005 |

* cited by examiner

*Primary Examiner* — Ryan Walsh
(74) *Attorney, Agent, or Firm* — Schiff Hardin LLP

(57) ABSTRACT

In a device or method to develop potential images of images to be printed, the potential images being generated on an intermediate image carrier using developer fluid having a charged toner and carrier fluid, developing with an applicator device the potential images, the applicator device directing the developer fluid across the intermediate image carrier. With the feed device the developer fluid is supplied to the applicator device, the feed device discharging excess developer fluid depleted of toner and that is not transferred to the applicator device. With a conditioning device the carrier fluid is taken from the applicator device and the taken up carrier fluid is discharged. With a cleaning device residual developer fluid remaining after development of the potential images is cleaned off of the applicator device and the residual developer fluid is supplied to a chamber arranged in the cleaning device. The discharge from the feed device and the discharge from the conditioning device are fed to the cleaning device chamber.

14 Claims, 2 Drawing Sheets

DEVICE AND METHOD TO DEVELOP POTENTIAL IMAGES GENERATED ON AN INTERMEDIATE IMAGE CARRIER IN AN ELECTROGRAPHIC PRINTING OR COPYING DEVICE

BACKGROUND OF THE INVENTION

For single color or multicolor printing of a recording material (for example a single sheet or a belt-shaped recording material) made of the most varied materials, for example paper or thin plastic or metal films, it is known to generate image-dependent potential images (charge images) on an intermediate image carrier (for example a photoconductor) that correspond to the images to be printed and comprised of regions (image areas) that are to be inked and regions that are not to be inked (non-image areas). The regions of the potential images that are to be inked are made visible via toner with a developer station. The toner image is subsequently transfer-printed onto the recording material.

Developer fluid containing toner and carrier fluid can thereby be used to ink the potential images. The carrier fluid thereby has a specific resistance of greater than $10^8$ Ohm*cm. Possible carrier fluids are silicon oil and hydrocarbons, among other things.

One method for electrophoretic liquid developing (electrographic developing) in digital printing systems is known from WO 2005/013013 A2 (=U.S. Pat. No. 7,463,851 B2) or DE 10 2005 055 156 B3 (=US 2008/0279597), for example. A carrier fluid containing silicone oil, with dye particles (toner) dispersed in it, is thereby used as a developer fluid. This can be learned in more detail from WO2005/013013 A2 or DE 10 2005 055 156 B3.

The feed of the liquid developer to the intermediate image carrier can take place via an applicator roller to which the liquid developer is supplied by what is known as a raster or screen roller at which is arranged a chamber blade. The use of chamber blades for ink supply is known from offset printing (EP 1 097 813 A2). The use of a chamber blade in electrophoretic printing can be learned from WO 2005/013013 A2. One disadvantage of the chamber blades known from these is that the flow of the developer fluid in the chamber blade is not specifically directed. Eddies can therefore occur, and air bubbles can be introduced. In addition to this, the filling of the cups of the raster roller takes place without potential assistance, such that the transfer of the toner particles to the raster roller is limited. The achievable toner application per surface element is thereby limited, and therefore the inking region or the speed of the transfer of the developer fluid onto the raster roller (and therefore the achievable process speed given constant inking).

The design of a raster roller that works together with a chamber blade is known from DE 44 08 615 A1. In order to enlarge the shape of the cups of the raster roller, a voltage is applied to the chamber blade and the raster roller. The raster roller is designed such that the shape of the cups can be varied via an electrical voltage.

According to EP 0 727 720 B1 (=U.S. Pat. No. 6,029,036 A), the cleaning of the residual image from the applicator roller (which residual image remains after the development of the potential images on the applicator roller) takes place via a blade resting on the applicator roller. However, an elastic coating of the applicator roller that is required for the nip formation at the intermediate image carrier is rapidly worn by the blade. In contrast to this, if the contact pressure of the blade is too weak a poor cleaning efficiency is accepted, which leads to memory effects given high print utilization (degree of areal coverage of the print image) since not every point of the applicator roller has the same toner quantity/area after a cycle. The cleaning of the applicator roller can also take place via a cleaning roller with blade (DE 10 2005 055 156 B3).

SUMMARY

It is an object to specify a device and a method with which a stable, substantially uniformly high inking of the potential images on an intermediate image carrier can be achieved in electrostatic printing methods. A high printing speed should thereby be possible.

In a device or method to develop potential images of images to be printed, the potential images being generated on an intermediate image carrier using developer fluid having a charged toner and carrier fluid, developing with an applicator device the potential images, the applicator device directing the developer fluid across the intermediate image carrier. With the feed device the developer fluid is supplied to the applicator device, the feed device discharging excess developer fluid depleted of toner and that is not transferred to the applicator device. With a conditioning device the carrier fluid is taken from the applicator device and the taken up carrier fluid is discharged. With a cleaning device residual developer fluid remaining after development of the potential images is cleaned off of the applicator device and the residual developer fluid is supplied to a chamber arranged in the cleaning device. The discharge from the feed device and the discharge from the conditioning device are fed to the cleaning device chamber.

DESCRIPTION OF PREFERRED EMBODIMENT

Figure 1:
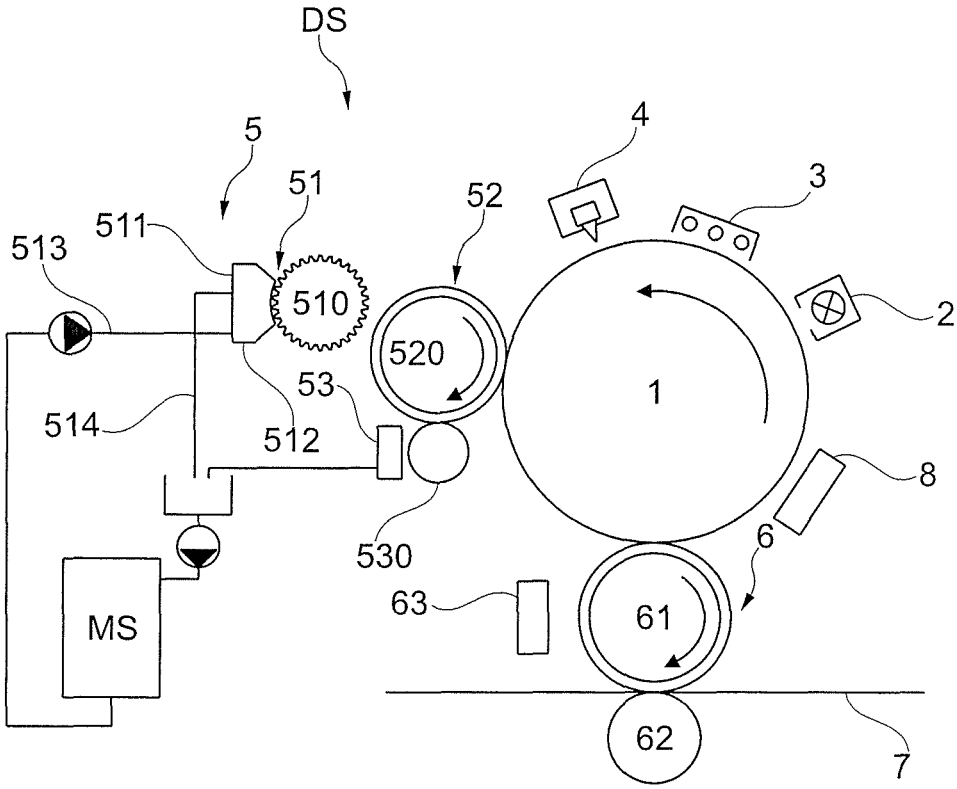
Fig. 1 (PRIOR ART)
FIG. 1 is a principle representation of an electrographic printing system according to prior art DE 10 2005 055 156 B3.

For the purposes of promoting an understanding of the principles of the invention, reference will now be made to a preferred embodiment/best mode illustrated in the drawings and specific language will be used to describe the same. It will nevertheless be understood that no limitation of the scope of the invention is thereby intended, and such alterations and further modifications in the illustrated method and such further applications of the principles of the invention as illustrated as would normally occur to one skilled in the art to which the invention relates are included.

Some objects which are achieved with one preferred embodiment are:

- a stable, uniform and high level of inking of the potential images;
- a stable inking for high print speed;
- a high process stability (long term stability)
  - for a large areal coverage range (0-100%);
  - for a large process speed range (0.3 to 5 m/sec);
  - with minimized loading of the developer fluid;
- a high print quality via optimized deposition of the toner on the intermediate image carrier;
- a large recording material spectrum via adaptation of the delivered distributed carrier fluid.

A developer device of one embodiment has:

an applicator device that is arranged adjacent to the intermediate image carrier and directs the developer fluid past the intermediate image carrier to develop the potential images, a feed device that supplies the developer fluid to the applicator device and that provides a spillover via which excess developer fluid that is not transferred to the applicator device is discharged, a conditioning device adjacent to the applicator device, which conditioning device accepts carrier fluid from the applicator device and discharges it via a drain, a cleaning device adjacent to the applicator device, which cleaning device cleans the residual developer fluid (remaining after the development of the potential images) off of the applicator device and supplies it to a partial chamber arranged in the cleaning device.

The spillover from the feed device and the drain of the conditioning device are likewise directed into the partial chamber of the cleaning device.

The developer device can operate with the following steps:

the developer fluid is extracted in low toner concentration from a mixing device for the developer fluid via the feed device (which has a chamber blade and a raster roller), In the transfer from the chamber blade into the cups of the raster roller, the developer fluid is concentrated into toner, wherein the excess developer fluid is supplied via a spillover of the chamber blade to a partial chamber of the cleaning device, the developer fluid is transferred in concentrated form from the raster roller to an applicator roller, the developer fluid on the applicator roller is concentrated further into toner by the acceptance of carrier fluid by a conditioning roller running on the applicator roller, wherein the accepted carrier fluid is supplied to the partial chamber of the cleaning device, the developer fluid in concentrated form is directed past the intermediate image carrier by the applicator roller in order to develop the potential images, the residual developer fluid on the applicator roller that is not transferred to the intermediate image carrier is cleaned off by a cleaning roller of the cleaning device into the partial chamber.

A developer fluid having optimally concentrated toner is supplied to the intermediate image carrier with the device according to one embodiment. However, excess developer fluid and carrier fluid are thereby discharged into the partial chamber of the cleaning device and there are mixed with the cleaned-off residual developer fluid, with the consequence that the toner concentration of the developer fluid in the half-chamber is low and the mobility of the toner is then high, such that the toner stress is reduced upon a resupply of the developer fluid into a mixing device. This advantage is further increased if, after the development of the potential images, carrier fluid is removed from the intermediate image carrier with the aid of a return roller and this carrier fluid is supplied to the cleaning roller before this cleans the residual developer fluid from the applicator roller.

The exemplary preferred embodiment is shown in the drawing Figures.

FIG. 1 shows components of a printing system DS as it is known from DE 10 2005 055 156 B3; DE 10 2005 055 156 B3 and the US equivalent US 2008/0279597 is herewith incorporated into this disclosure. Arranged along an intermediate image carrier 1 (a photoconductor drum in FIG. 1) are a regeneration exposure 2, a charge station 3, an element 4 for exposure according to the image, a developer device 5, a transfer unit 6 to transfer-print the potential images developed into toner images onto a recording material 7, and an element 8 for cleaning the photoconductor drum 1. The transfer unit 6 has an elastic transfer roller 60, a counter-pressure roller 62 and a cleaning unit 63.

Of the components arranged along the photoconductor drum 1 that are listed in FIG. 1, in the following the developer device 5 is handled in closer detail; the design and function of the remaining components are known and can be learned from DE 10 2005 055 156 B3, for example.

The known developer device 5 according to FIG. 1 has a feed device 51, an applicator device 52, a cleaning device 53 and possibly a conditioning device (not shown in FIG. 1). In FIG. 1 a chamber blade 511 with raster roller 510 is thereby provided as the feed device 51; an applicator roller 520 is provided as the applicator device 52; and a cleaning roller 530 is provided as the cleaning device 53. The developer fluid is supplied to the intake 513 of the chamber blade 511 from a mixing device MS and arrives from there at the raster roller 510 and from there to the applicator roller 520. The excess developer fluid in the chamber 512 is directed back into the mixing device MS via a spillover 514. The applicator roller 520 then directs the developer fluid past the intermediate image carrier 1 to ink the potential images. The residual developer fluid remaining on the applicator roller 520 after the inking of the potential images is cleaned off by the cleaning roller 530 and conducted to the mixing device MS again.

In the explanation of the preferred embodiment, a developer device according to FIG. 1 is assumed; the designations of the elements of the developer device are retained as much as possible without the invention being limited to the embodiment of FIG. 1.

Figure 2:
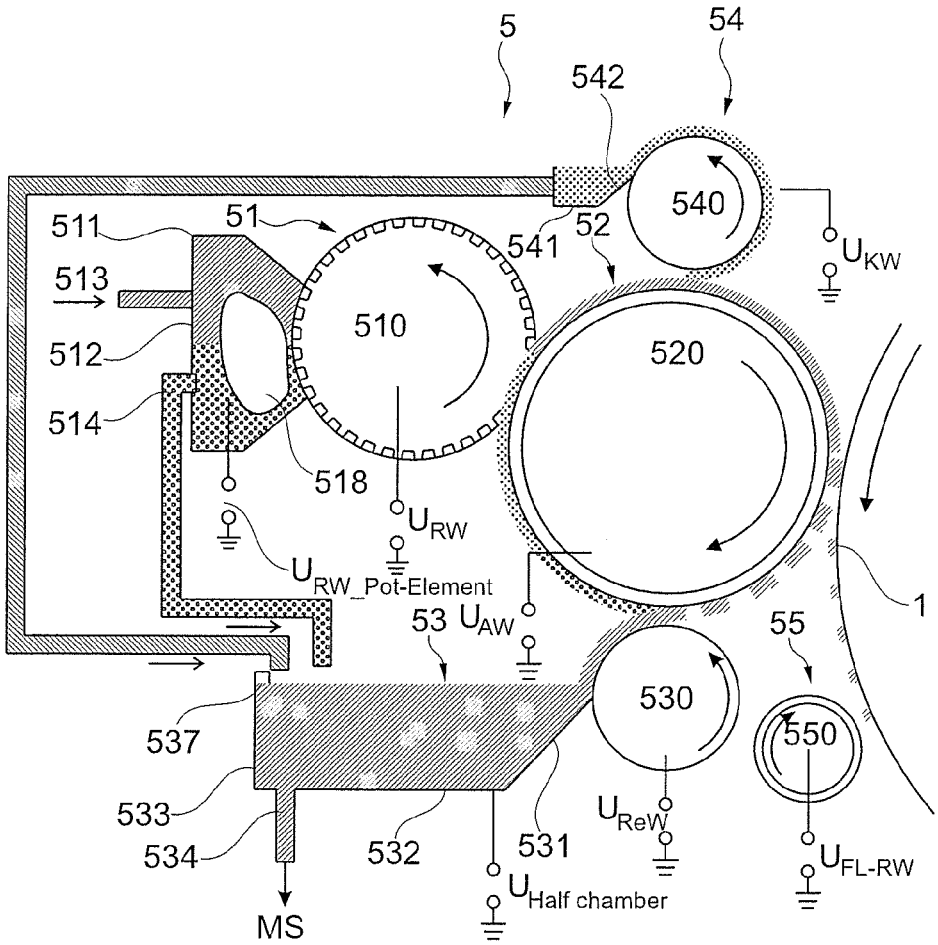
FIG. 2 illustrates the design of the device according to a preferred embodiment.

The embodiment of FIG. 2 likewise has a feed device 51, an applicator device 52, and a cleaning device 53, but also has a conditioning device 54. It additionally has a return feed device 55. These devices transport developer fluid to the intermediate image carrier 1 or remove carrier fluid from the intermediate image carrier 1. The elements that are used to transport the developer fluid can be rollers or belts. In the following embodiment rollers are assumed, without the embodiment being limited to rollers. Belts can thus also be present in place of the rollers. In the following explanation of one embodiment, a chamber blade 511 with a raster roller 510 is assumed as the feed device 51; an applicator roller 520 is assumed as the applicator device 52; a conditioning roller 540 is assumed as the conditioning device 54; a cleaning roller 530 is assumed as the cleaning device 53; and a return roller 550 is assumed as the return device 55. The developer fluid thereby has at least one insulating carrier fluid with charged dye particles (toner) dispersed in it, wherein the charge of the toner can be positive or negative. In the following a positively charged toner is assumed in the explanation.

A basic mode of operation of the developer device 5 is enumerated as follows:

The developer fluid is directed to the applicator roller 520 via the raster roller 510, wherein the toner concentration in the developer fluid is increased so that this is sufficient for the inking of the potential images on the intermediate image carrier 1.

The toner concentration is thereby optimized for a good flow response behavior. This means a good emptying response from the raster roller 510 and a sufficient uniformity of the film of developer fluid on the applicator roller 520.

The film of developer fluid applied to the applicator roller 520 is modified by the conditioning roller 540. The toner is thereby pushed towards the applicator roller 520 with the aid of a voltage $U_{KW}$. In addition to this, carrier fluid is thereby taken from the applicator roller 520 via the conditioning roller 540 and supplied to a partial chamber 532 arranged in the cleaning device 53.

A conditioned film of developer fluid subsequently arrives in the contact zone between applicator roller 520 and intermediate image carrier 1 for image development. The electrical potentials at applicator roller 520 and intermediate image carrier 1 are chosen so that toner passes onto the intermediate image carrier 1 in the image regions and the applied toner does not pass onto the intermediate image carrier 1 in the non-image regions. Carrier fluid is additionally also transferred onto the intermediate image carrier 1.

The residual developer fluid of the residual image that remains on the applicator roller 520 after the development is cleaned off of the applicator roller 520 by the cleaning roller 530. The residual image is thereby transferred onto the cleaning roller 530 via the cleaning roller 530 (which is in contact with the applicator roller 520) and an electrical voltage between these rollers ($U_{AW/ReW}$). A subsequent cleaning blade 530 arranged on the cleaning roller 530 removes the residual image and directs it into the partial chamber 532. The scraped-off toner and carrier fluid are supplied back from there to the mixing device MS (FIG. 1). The supply of developer fluid to the feed device 51 is fed from this mixing device MS.

An additional reduction of carrier fluid to the intermediate image carrier 1 can occur with the aid of the return roller 550, with the consequence that the discharge of carrier fluid to the recording material 7 is reduced. The removed carrier fluid can simultaneously be supplied to the cleaning roller 530 in order to facilitate the take-up of the residual developer fluid. This embodiment is particularly advantageous in extreme printing modes.

A more detailed design of the feed device 51 can be learned from FIG. 2. This contains the chamber blade 511 with the chamber 512, the intake 513, the spillover 514 and the raster roller 510 with cups and webs, At least one insulated flow element 518 is arranged adjacent to the raster roller 510 within the chamber 512 of the chamber blade 511 that is open to the raster roller 510, to which raster roller 510 an electrical potential $U_{RW_Pot\text{-}element}$ can be applied. The flow element 518 lies parallel to the raster roller 510 and extends over the width of the chamber 512. It can be attached in an electrically insulated manner to side walls of the chamber 512 and can be comprised of an electrically conductive profile element. The chamber 512 can likewise be at an electrical potential, likewise the raster roller 510 at a potential $U_{RW}$.

A sufficient feed of toner in the developer fluid into the cups of the raster roller 510, which is necessary for a high level of inking of the potential images on the intermediate image carrier 1 at high printing speed, is achieved via a sufficient feed and distribution of the developer fluid in the chamber blade 511 and via an electrical field assistance within the chamber blade 511. An optimum of the through-flowing volume of developer fluid along the raster roller 510 and the achievable electrical field strength as a result if the separation between the raster roller 510 and the flow element 518 provided with the potential $U_{RW_Pot\text{-}element}$ is thereby required.

The supplied developer fluid is distributed into the chamber blade 511 via the intake 513 such that the fluid amount supplied via the intake 513 is always greater than or equal to the amount that can discharge via the cups of the raster roller 510 and the spillover 514;

the excess amount of developer fluid that is depleted of toner can discharge via the spillover 514 and is supplied to the partial chamber 532 of the cleaning device 53;

the flow element 518 arranged in the chamber 512 enables and supports the distribution of the developer fluid transversal to the printing direction;

the flow element 518 is arranged and shaped relative to the raster roller 510 and the inner contour of the chamber 512 such that no discontinuities of the developer fluid can occur in the flow cross section, and as a result a flow arises in the gap between the flow element 518 and raster roller 510, which flow is rectified to the movement direction of the surface of the raster roller 510.

The arrangement and contour of the flow element 518 thereby has the effect that no field strength peaks arise and the region between the flow element 518 and the raster roller 510 is always filled with developer fluid. The achievable field strength is correspondingly markedly higher than the air breakdown field strength and is in the range between 10 to 400 V/cm, preferably 30-100 V/cm.

Via this realization of the feed device 51, the cups of the raster roller 510 are filled with toner in a defined manner via field assistance between the flow element 518 and the raster roller 510. The toner concentration is thereby first increased upon filling of the cups of the raster roller 510; a low-concentration (and therefore better pourable) developer fluid can thus be dosed beforehand.

Furthermore, the design of the conditioning device 54 with a conditioning roller 540 arises from FIG. 2. This is located in contact with the developer fluid film on the applicator roller 520. The conditioning roller 540 is provided with a separate electrical potential $U_{KW}$ that is greater than the electrical potential $U_{AW}$ of the applicator roller. The resulting voltage between conditioning roller 540 and applicator roller 520 is in the range of 10 V to 2000 V, advantageously in the range from 200 V to 1000 V. The applicator roller 520 and the conditioning roller 540 roll on one another. The surface velocity of the conditioning roller 540 amounts to 0.8:1 to 1:0.8 (advantageously 1:1) in comparison to the applicator roller 520. The toner particles here are likewise pushed from the surface of the developer fluid film towards the applicator roller 520.

Via the suitable selection of the diameter of the conditioning roller 530, a separating flow is additionally generated between conditioning roller 540 and applicator roller 520. The diameter of the conditioning roller 540 is selected relative to this in a range from 0.1 to 0.7 of the diameter of the applicator roller 520, advantageously 0.2 to 0.5. Due to the small diameter of the conditioning roller 540, the separating flow has a pronounced velocity vector perpendicular to the surface of the applicator roller 520. The disruption of the fluid layer thickness that is created at the film gap after the roller contact has a small period length (<100 μm) and at the same time a low amplitude. This has the effect of a macroscopic smoothing of the fluid surface, accordingly a uniform distribution of the toner particles on the applicator roller 520 (and subsequently in the print image).

A conditioning blade 542 can be arranged at the conditioning roller 540. The conditioning blade 542 removes the carrier fluid located on the conditioning roller 540 (which carrier fluid is depleted of toner particles due to the applied electrical field) and directs this into a capture channel 541. The film of developer fluid that remains on the applicator roller 520 accordingly has an increased concentration of toner; at the same time the layer thickness of the developer fluid is smaller. The field strength in the gap between intermediate image carrier 1 and applicator roller 520 is determined by the invariant applied electrical potentials and the distance between the two. The distance is reduced corresponding to the reduced layer thickness of the developer fluid and therefore leads to a higher field strength in the gap between intermediate image carrier 1 and applicator roller 520, which is advantageous for the development process.

The capture channel 541 has an outflow that is connected with the partial chamber 532 of the cleaning device 53. Carrier fluid is supplied to the partial chamber with this, via which carrier fluid the toner concentration in the partial chamber 532 is reduced, with the consequence that the viscosity of the residual developer fluid is lower and the residual developer fluid can be transported more easily.

According to FIG. 2, the cleaning device 53 has a cleaning roller 530 that is wider than the applicator roller 520 and that cleans the residual image that remains on the applicator roller 520 off of said applicator roller 520. A cleaning blade 531 rests on the cleaning roller 530, which cleaning blade 531 strips the residual image cleaned off of the applicator roller 520 from the cleaning roller 530. The cleaning blade 531 is part of a partial chamber 532 that has a pan 533 and an outflow 534 that, for example, can be connected with the mixing device MS. A fill level sensor 537 can optionally be provided in order to control the outflow of the residual developer fluid to the mixing device MS.

The cleaning blade 531 arranged at the cleaning roller 530 is integrated into the partial chamber 532. The partial chamber 532 has lateral seals. With these it is achieved that the residual developer fluid stripped off from the cleaning roller 530 by the cleaning blade 531 flows into the partial chamber 532. The partial chamber 532 is designed such that a level of developer fluid is maintained that is above the cleaning blade 531, with the consequence that toner located on the cleaning roller 530 disperses in the quantity of developer fluid that is present. For this either a spillover 534 above the level of the cleaning blade 531 or a discharge pump (not shown in FIG. 2) that can be adjusted via the fill level sensor 537 can be provided.

A return roller 550 can be arranged adjacent to the intermediate image carrier 1 and after the inking region of the potential images (as viewed in the movement direction of the intermediate image carrier 1), which return roller 550 takes up carrier fluid from the intermediate image carrier 1. The return roller 550 thereby has an electrical potential $U_{FL-RW}$ that is in the range of the charge potential (+/−30%) of the intermediate image carrier 1 (i.e. the non-image regions) and therefore is greater than the electrical potential of the cleaning roller 530. It is therefore ensured that charged toner is not transferred from the intermediate image carrier 1 onto the return roller 550. If the return roller 550 is additionally arranged adjacent to the cleaning roller 530, due to the different electrical potentials toner is also not transferred from the cleaning roller 530 to the return roller 550. The function of the return roller therefore exists in the partial return transfer of carrier fluid from the intermediate image carrier 1 onto the cleaning roller 530.

The use of a return roller 550 is particularly advantageous in the following operating modes of the printing system DS:

- Given very small areal coverages (<3%) of the information to be printed. Otherwise, too much carrier fluid would result on the recording material 7.
- Given particularly low printing speeds since the long residence time can lead to an increased toner stress in the cleaning.
- Given strongly fluctuating areal coverages (>50% fluctuation) in two successive revolutions.

The rollers (raster roller 510, cleaning roller 530, conditioning roller 540, applicator roller 520, return roller 550) used in the devices respectively have surface coatings that are chosen so that

- no electrical current (or only such a low electrical current) flows via direct contact (for example webs of the raster roller 510 on applicator roller 520, cleaning roller 530 or conditioning roller 540 on applicator roller 520) such that different electrical potentials of the rollers can be kept stable by the connected power supplies (current advantageously <100 μA/1m roller width; potential fluctuations advantageously <+/−10 V),
- the current-limiting coating is thereby (advantageously) not applied to the applicator roller 520 and the return roller 550 but rather to the respective adjoining roller (510, 530, 540),
  - in order to ensure a conductive coating of the applicator roller 520 (specific resistance $<10^7$ Ω*cm), the current-limiting coating on the raster roller 510, cleaning roller 530 and conditioning roller 540 is in the range between $10^8$ Ω*cm and $10^{10}$ Ω*cm, advantageously $5*10^8$ and $5*10^9$ Ω*cm, wherein the voltage drop occurring over these coatings is <100 V,
- a current limitation is thus present at every contact location of the rollers.

At the same time the roller resistances should be selected so that they are always lower than the specific resistance of the developer fluid. The electrical field that is available for the toner transfer is therefore maximized.

The coating of the elastic applicator roller 520 and of the elastic return roller 550 can have a specific resistance in the range between $10^5$ and $10^7$Ω*cm; the resistance fluctuations can be <+/−20% (advantageously <+/−10%); the layer thickness is between 4 and 12 mm, advantageously 7 to 10 mm. Among other things, NBR (nitrile butadiene) rubber or PUR (polyurethane) rubber can be selected as a material. If the coating of the applicator roller 520 and of the return roller 550 has two layers, the outer layer can comprise PVDF (polyvinylidene fluoride), ECO (epichlorohydrin), fluorelastomer, Teflon and have a layer thickness<0.7 mm; the inner layer can be comprised of any of the materials cited above.

The coating of the raster roller 510 and of the cleaning roller 530 can have a resistance between $10^8$Ω*cm and $10^{10}$Ω*cm and a layer thickness between 10 and 400 μm, advantageously between 50 and 200 μm. Among other things, Hart-Coat, ceramic (aluminum oxide, chromium oxide, titanium oxide or a mixture of these) can be selected as a material.

As results from the explanation of the device according to one embodiment, all functional elements are provided with a defined electrical potential. The following points of view are selected for the selection of the potentials:

- all potentials result from the superimposition of a direct voltage portion and alternating voltage portion; each portion can thereby be zero;
- all rollers (belts)—thus the applicator roller 520, the raster roller 510, the cleaning roller 530, the conditioning roller 540 and the return roller 550—are provided with a separate potential;
- the chamber blade 511 advantageously has the same potential as the raster roller 510, optionally even a higher potential in comparison to the raster roller 510;
- the cleaning blade 531 and the partial chamber 532 (lateral seal) advantageously have the same potential as the cleaning roller 530, optionally even a higher potential;
- the potential of the flow element 518 has been described above.

Given rollers (510, 520, 530, 540, 550) the potentials are applied at the inside of the rollers (510, 520, 530, 540, 550); given belts the potentials are applied on their insides.

The surface coatings of the rollers form a system of specific resistances ρ matched to one another. It thereby applies that:

ρ(raster roller)>ρ(applicator roller);

ρ(cleaning roller)>ρ(applicator roller);

ρ(conditioning roller)>ρ(applicator roller);

ρ(cleaning roller)>ρ(return roller).

The particular advantages of the device according to one embodiment are visible in summary in the following features:

The toner is deposited or, respectively, taken up in a defined manner within the developer fluid at every function element (raster roller, applicator roller, cleaning roller). Fluctuations of the toner (charge, diameter) are thereby compensated.

The optimal toner concentration is set for each step of the transport of the developer fluid from roller to roller:

1) A medium toner concentration for good pourability of the developer fluid for the toner application at the feed device 51 (for example the filling of the raster roller chambers 512) is assumed.
2) Concentration takes place in the application on the applicator roller 520 (via field-assisted filling in one embodiment of the raster roller 510) for an optimally efficient toner application.
3) Additional concentration takes place via a conditioning by the conditioning roller 540, including the formation of a thin cover layer of carrier fluid for the following step of the image development on the intermediate image carrier 1.
4) Reduction of the delivered carrier fluid quantity is implemented at the intermediate image carrier 1 for a better fixing capability.
5) Direct return of developer fluid depleted of toner to the partial chamber 532 of the cleaning device 53 takes place from the spillover of the chamber blade 511;

from the conditioning blade 542 of the conditioning roller 540 in the partial chamber of the cleaning device 53;

via the application of the carrier fluid from the return roller 550 over the entire surface of the cleaning roller 530;

since there an optimally low-concentration developer fluid leads to good mobility of the toner, and as a result of this leads to a reduced toner stress, and therefore to a better stability.

The returns within the developer device 5 moreover lead to a reduction of the necessary volume flows of developer fluid that must be conveyed back and forth to the intermediate image carrier 1. Fluctuations due to different printing loads can therefore be compensated more quickly.

The use of a conditioning roller 540 in contact with the applicator roller 520 and the applied electrical potentials yields the following advantages.

1) It leads to the formation of a film that, at the surface of the conditioning roller 540, is comprised predominantly of carrier fluid and is concentrated with toner at the surface of the applicator roller 520. The film split then predominantly takes place in the partial layer made up of carrier fluid. In the next process step a thin layer of carrier fluid is therefore located on the film surface, whereby the unintended depositing in non-image regions on the intermediate image carrier 1 is avoided. Alternatively, a higher process speed can thereby be achieved.
2) The suitable selection of the diameter of the rollers and the adjustable relative speed leads to a stabilization of the film split in the nip between applicator roller 520 and conditioning roller 540, and therefore to a smoothing of the film of developer fluid on the applicator roller 520 and to a uniform depositing on the intermediate image carrier 1.
3) The toner concentration of the film of carrier fluid that remains on the applicator roller 520 is increased via the scraping off of the carrier fluid located on the conditioning roller 540. In the contact between applicator roller 520 and intermediate image carrier 1, a higher concentration of developer fluid leads to a smaller film thickness, and therefore to an increase of the electrical field between applicator roller 520 and intermediate image carrier 1, and thus to an improvement of the deposition (in particular for high process speeds).
4) The carrier fluid recovered by the return roller 550 is returned to the cleaning device 53, and therefore the toner concentration of the developer fluid to be cleaned off is reduced.

The use of the return roller 550 and the applied electrical potentials enable the control of the delivered carrier fluid amount without a return transfer of toner, so that 1) no unnecessary carrier fluid is delivered via the additional nip points to the recording material 7, and therefore from the printing system DS;
2) the recovered carrier fluid is applied to the cleaning roller, and therefore the toner concentration of the developer fluid to be cleaned off is reduced.

Although a preferred exemplary embodiment is shown and described in detail in the drawings and in the preceding specification, it should be viewed as purely exemplary and not as limiting the invention. It is noted that only a preferred exemplary embodiment is shown and described, and other embodiments may be provided, and all variations and modification that presently or in the future lie within the protective scope of the invention should be protected.

I claim as my invention:

1. A device to develop potential images of images to be printed, said potential images being generated on an intermediate image carrier using developer fluid having a charged toner and carrier fluid in an electrographic printing or copying device, comprising:

an applicator device to develop the potential images adjacent to the intermediate image carrier, said applicator device directing the developer fluid to pass over the intermediate image carrier;

a feed device that supplies the developer fluid to the applicator device and that has a spillover arranged such that excess developer fluid that is not transferred to the applicator device is discharged;

a return roller adjacent to said intermediate image carrier which takes up carrier fluid from the intermediate image carrier;

a cleaning device comprising a cleaning roller adjacent to the applicator device, said cleaning device cleaning residual developer fluid remaining after development of the potential images off of the applicator device and supplies the residual developer fluid to a fluid receiving element;

said return roller also being adjacent the cleaning roller such that the carrier fluid taken up from the intermediate image carrier passes onto the cleaning roller which transports the carrier fluid to the fluid receiving element, the carrier fluid taken up from the intermediate image carrier passing onto the cleaning roller before a contact point between the applicator roller and the cleaning roller; and the spillover from the feed device being connected with the fluid receiving element.

2. The device of claim 1 in which:

a chamber blade and a raster roller are provided as said feed device, said raster roller accepting the developer fluid from a mixing device;

the applicator device having an applicator roller and between the applicator roller and the raster roller an electrical voltage is applied such that toner transfer from the raster roller to the applicator roller can be adjusted by said voltage; and the chamber blade having a chamber that is open to the raster roller, with an intake and with said spillover for the developer fluid, the intake being connected with the mixing device and receiving a quantity of developer fluid supplied by the mixing device, said quantity being greater than or equal to a quantity that transfers to the raster roller, wherein the excess quantity of the developer fluid depleted of toner flows over the spillover to the fluid receiving element.

3. The device according to claim 2 in which the feed device has, adjacent to the raster roller, at least one flow element arranged in the chamber blade chamber, said chamber blade chamber having an electrical voltage applied between the at least one flow element and the raster roller, said electrical voltage adjusting the transfer of the toner into cups of the raster roller.

4. The device according to claim 2 in which;

the cleaning device has said cleaning roller and a cleaning blade resting on the cleaning roller; and the residual developer fluid scraped off by the cleaning blade flowing into the fluid receiving element.

5. The device according to claim 4 in which the fluid receiving element has lateral seals, the cleaning blade, and a pan, the fluid receiving element being designed such that a level of the developer fluid is always above the cleaning blade so that the toner present on the cleaning roller disperses in the fluid receiving element, and the fluid receiving element having an outflow connected with the mixing device.

6. The device according to claim 1 in which a conditioning device having a conditioning roller is arranged adjacent to the applicator device before the intermediate image carrier as viewed in a movement direction of the developer fluid.

7. The device according to claim 6 in which carrier fluid at the conditioning roller is conveyed to a capture channel, the capture channel being connected with the fluid receiving element in order to supply the scraped-off carrier fluid to the fluid receiving element.

8. The device according to claim 1 in which the return roller is at an electrical potential that is in a range of a charge potential of non-image regions on the intermediate image carrier and is set via an electrical potential applied to the cleaning roller.

9. The device according to claim 8 in which a current-limiting coating is provided to at least a conditioning roller adjacent an application roller of the application device and the cleaning roller, said coating being selected such that no current or at most a current <100 μA/m can flow given direct contact of the rollers, resistances of the applicator roller, the cleaning roller, the conditioning roller, and the return roller being set so that they are lower than a specific resistance of the developer fluid.

10. The device according to claim 9 in which a coating of the applicator roller and the return roller is set such that a transport volume of developer fluid over contact points between the applicator roller and the cleaning roller, or the intermediate image carrier and the return roller, or the return roller and the cleaning roller, or the applicator roller and the conditioning roller is always greater than a volume of a film thickness of incoming developer fluid.

11. A method to develop potential images of images to be printed, said potential images being generated on an intermediate carrier using developer fluid having a charged toner and carrier fluid, comprising the steps of:

developing with an applicator device the potential images, the applicator device directing the developer fluid past the intermediate image carrier;

supplying with a feed device the developer fluid to the applicator device, said feed device discharging excess developer fluid depleted of toner and that is not transferred to the applicator device;

providing said intermediate carrier as a roller, providing a return roller adjacent to the intermediate carrier roller, and taking up carrier fluid from the immediate carrier roller by use of said return roller;

cleaning with a cleaning device comprising a cleaning roller residual developer fluid remaining after development of potential images off of the applicator device and supplying the residual developer fluid to a fluid receiving element;

said return roller also being adjacent the cleaning roller such that the carrier fluid taken up from the intermediate image carrier passes onto the cleaning roller which transports the carrier fluid to the fluid receiving element, the carrier fluid taken up from the intermediate image carrier passing onto the cleaning roller before a contact point between the applicator roller and the cleaning roller; and feeding the discharge from the feed device to the fluid receiving element.

12. The method of claim 11 comprising the further steps of:

removing developer fluid in a low toner concentration from a mixing device via said feed device, said feed device having a chamber blade and a raster roller;

concentrating the developer fluid in terms of toner in cups of the raster roller in a passage from the chamber blade, and said excess developer fluid being supplied via a spillover to the fluid receiving element;

providing the applicator device as an applicator roller and also providing a conditioning device comprising a conditioning roller running on the applicator roller;

directing the developer fluid in a form that is concentrated in terms of toner past the intermediate image carrier by the applicator roller in order to develop the potential images; and cleaning off the residual developer fluid on the applicator roller that is not transferred to the intermediate image carrier into the fluid receiving element by the cleaning roller of the cleaning device.

13. The method according to claim 12 in which:

carrier fluid is removed from the intermediate image carrier by said return roller resting on the intermediate image carrier before the toner images are transfer-printed onto a recording material.

14. A device to develop potential images of images to be printed, comprising:

an intermediate image carrier having potential images generated thereon and said potential images being developed by a developer fluid having a charged toner and carrier fluid;

an applicator device for said development of the potential images adjacent to the intermediate image carrier;

a feed device that supplies the developer fluid to the applicator device and that discharges excess developer fluid depleted of toner that is not transferred to the applicator device;

a return roller adjacent to the intermediate image carrier and which collects carrier fluid from the intermediate image carrier, said return roller also being adjacent to and in contact with a cleaning roller of a cleaning device;

said cleaning device cleaning roller being adjacent to the applicator device, said cleaning device cleaning residual developer fluid remaining after development of the potential images off of the applicator device and supplies the residual developer fluid to a fluid receiving element;

the discharge from the feed device being fed to the fluid receiving element; and said return roller passing on said carrier fluid collected from the intermediate image carrier onto the cleaning roller which transports the carrier fluid to the fluid receiving element, the carrier fluid taken up from the intermediate image carrier passing onto the cleaning roller before a contact point between the applicator roller and the cleaning roller.

* * * * *